US010234238B1

(12) United States Patent
Thomas et al.

(10) Patent No.: US 10,234,238 B1
(45) Date of Patent: Mar. 19, 2019

(54) REFLEX SIGHT WITH TWO POSITION-ADJUSTABLE RETICLES

(71) Applicant: KRUGER OPTICAL, INC., Tigard, OR (US)

(72) Inventors: Mark Thomas, Portland, OR (US); Mitchell Thomas, Tigard, OR (US)

(73) Assignee: KRUGER OPTICAL, INC., Tigard, OR (US)

( * ) Notice: Subject to any disclaimer, the term of this patent is extended or adjusted under 35 U.S.C. 154(b) by 0 days.

(21) Appl. No.: 15/906,329

(22) Filed: Feb. 27, 2018

(51) Int. Cl.
*F41G 1/30* (2006.01)
*F41G 3/08* (2006.01)

(52) U.S. Cl.
CPC ..... *F41G 1/30* (2013.01); *F41G 3/08* (2013.01)

(58) Field of Classification Search
CPC ..... F41G 1/30; F41G 1/12; F41G 1/26
See application file for complete search history.

(56) References Cited

U.S. PATENT DOCUMENTS

| | | | | |
|---|---|---|---|---|
| 8,201,741 | B2 | 6/2012 | Bennetts et al. | |
| 8,459,822 | B1 | 6/2013 | Lambert et al. | |
| 9,057,583 | B2 * | 6/2015 | Matthews | F41G 1/30 |
| 2015/0198415 | A1 * | 7/2015 | Campean | F41G 1/18 42/137 |
| 2017/0211910 | A1 * | 7/2017 | Olmsted | F41G 1/30 |
| 2018/0128574 | A1 * | 5/2018 | Crispin | F41G 1/30 |

FOREIGN PATENT DOCUMENTS

CA 2811691 * 3/2012

* cited by examiner

*Primary Examiner* — Stephen Johnson
(74) *Attorney, Agent, or Firm* — Timothy E. Siegel Patent Law, PLLC; Timothy E. Siegel

(57) ABSTRACT

A reflex sight, having a mounting base that has an engagement element for attachment to a firearm. Also, a collimating front lens is mounted on the mounting base. A first reticle projection system projects a first reticle onto the front lens, at a first position, the first position being user adjustable, relative to the mounting base, by a first actuation assembly. In addition, a second reticle projection system, projecting a second reticle onto the front lens at a second position, the second position being user adjustable, relative to the first position by a second actuation assembly.

12 Claims, 6 Drawing Sheets

REFLEX SIGHT WITH TWO POSITION-ADJUSTABLE RETICLES

BACKGROUND

Short range projectile weapons, for example pistols, shotguns and crossbows, typically have a lower barrel velocity than a rifle, resulting in significant variation in bullet drop, dependent on range, even at a relatively short range, for example 50 yards. The reflex sights typically used to aid a shooter in aiming such a firearm, however, only permit a single indicator of where a bullet will hit, thereby requiring a shooter to form a mental estimate of the hitting point for a range different from that for which the reticle position has been set.

Also, there is a fair amount of uncertainty in the angle at which a projectile will leave the weapon, or for a shotgun, the area over which pellets will hit. There are currently limited options for assisting a shooter in forming an estimate of an area over which a projectile is likely to hit, or shotgun pellets will hit. Conversely, there are limited options for determining where a bullet will quite certainly not hit, so that it may be difficult at times to estimate potential collateral damage.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a reflex sight, having a mounting base that has an engagement element for attachment to a firearm. Also, a collimating front lens is mounted on the mounting base. A first reticle projection system projects a first reticle onto the front lens, at a first position, the first position being user adjustable, relative to the mounting base, by a first actuation assembly. In addition, a second reticle projection system, projecting a second reticle onto the front lens at a second position, the second position being user adjustable, relative to the first position by a second actuation assembly.

In a second separate aspect, the present invention may take the form of a reflex sight having two reticles of differing sizes, each reticle being separately activated.

In a third separate aspect, the present invention may take the form of a reflex sight displaying a pattern of reticles in a field of view providing an indication of an angular area in the field of view, and wherein the pattern of reticles is adjustable to cover a larger or smaller angular area in the field of view, to reflect ordinance spread for a specific ordinance used and firearm setting.

In a fourth separate aspect, the present invention may take the form of a method of aiming a projectile weapon, based on prior knowledge of an aiming point range, and utilizing a reflex sight, attached to the weapon, the reflex sight including a first reticle and a second reticle, which are independently adjustable in elevation. The method begins with positioning the first reticle to reflect projectile drop at a range of less than 10 yards and continues with the positioning of the second reticle, to reflect bullet drop at the aiming point range. The method concludes with the alignment of the second reticle at a point, relative to a target, that is reflective of a range difference between the target and the aiming point.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Definition

"Ordinance Spread" in the context of a single projectile weapon, such as a handgun or a crossbow, is the angular area over which a projectile may hit, due to uncertainty as to the projectile launch. In the context of a multi-projectile weapon, such as a shotgun, it is the area of which projectiles (shot) are likely to hit.

Description

Figure 1:
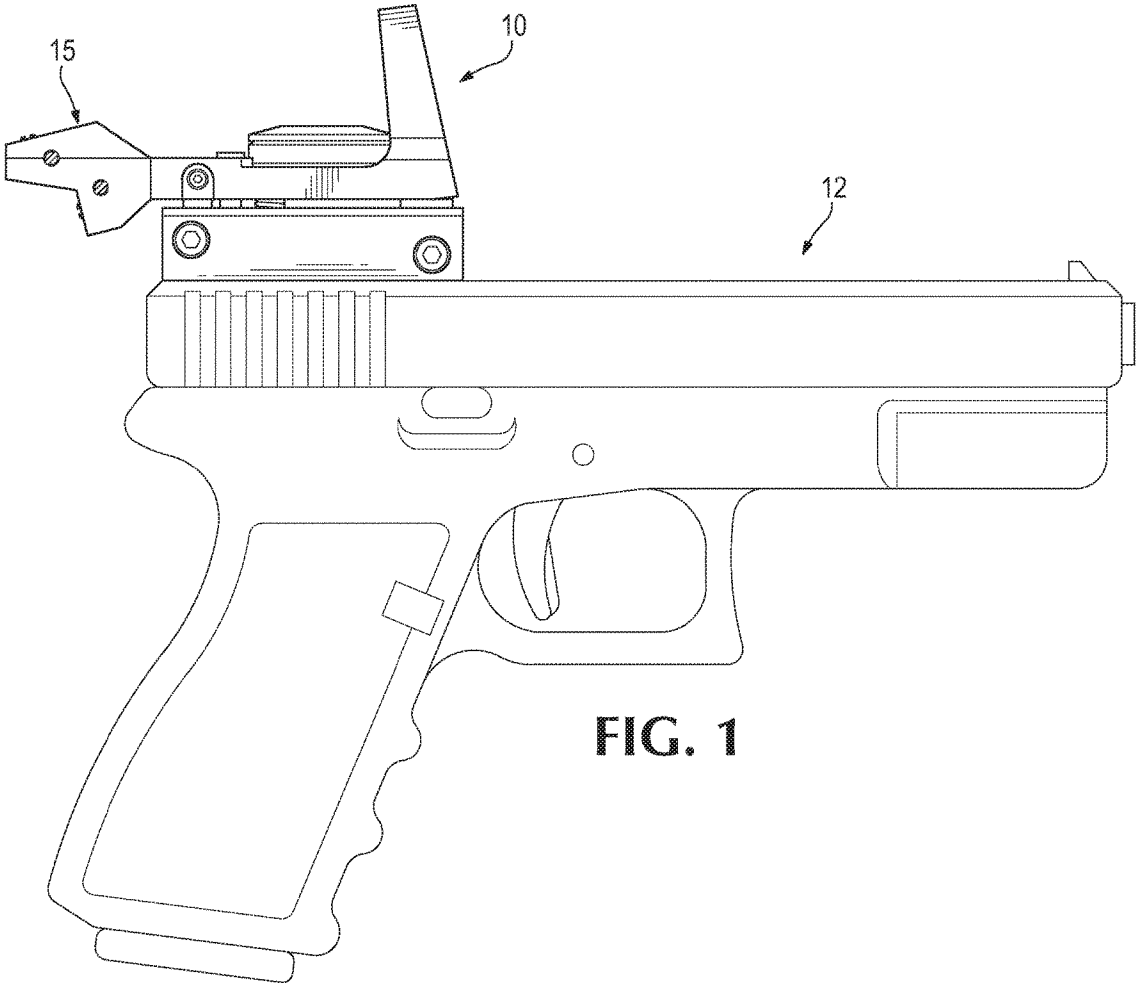
FIG. 1 is a side view of a reflex sight according to the present invention, mounted on handgun.
Figure 2:
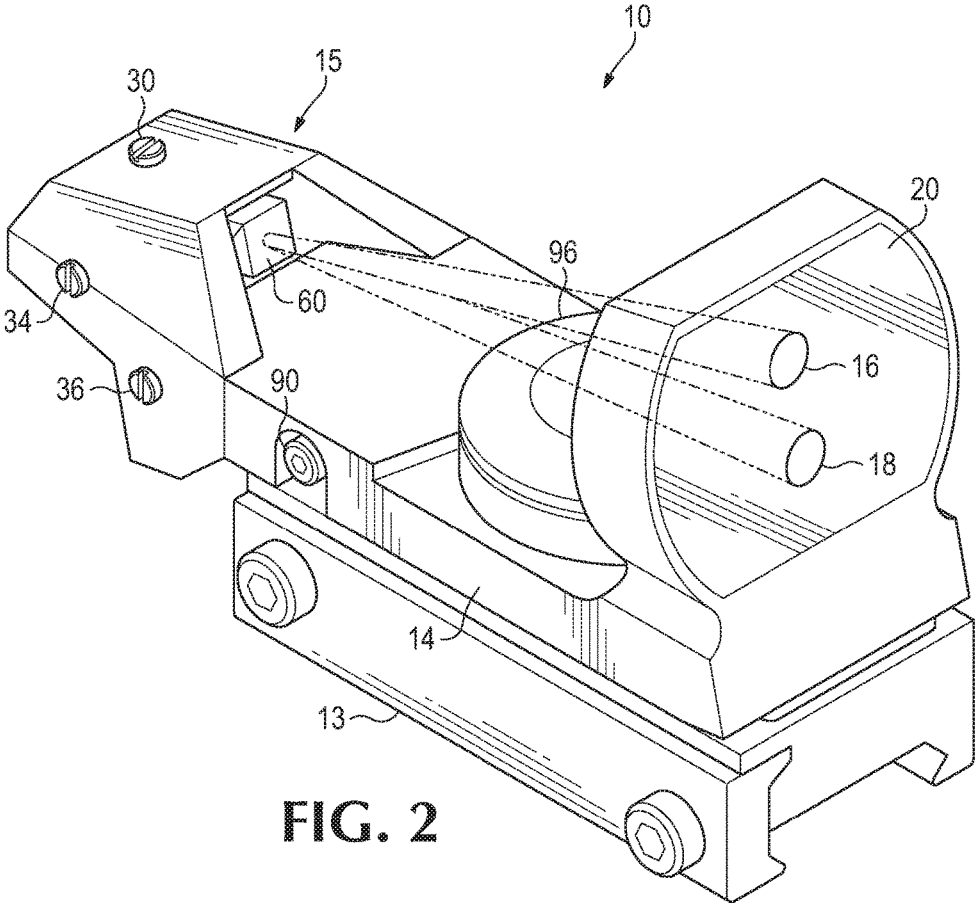
FIG. 2 is an isometric view of the reflex sight of FIG. 1, showing the projection of two reticles onto the front lens of the sight.
Figure 3:
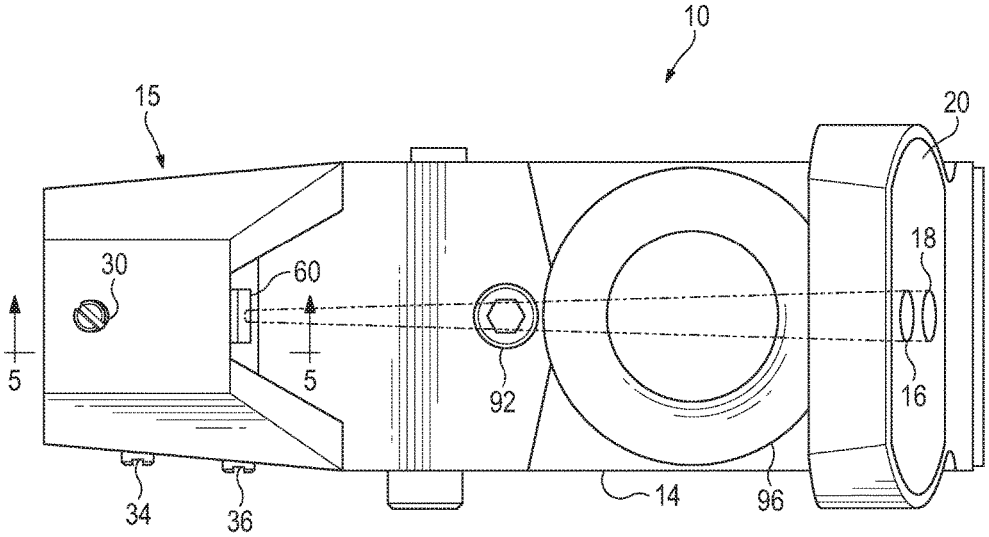
FIG. 3 is a top view of the reflex sight of FIG. 2, in the same configuration.
Figure 4:
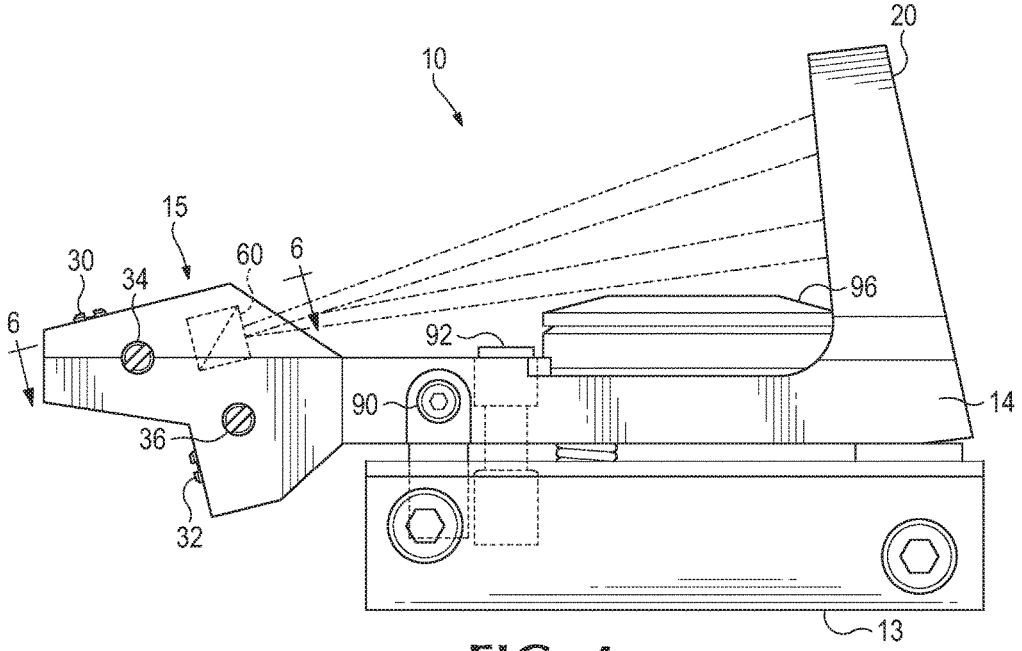
FIG. 4 is a side view of the reflex sight of FIG. 2, in the same configuration.

Referring to FIG. 1, a reflex sight 10, according to a preferred embodiment of the present invention, is shown attached to a handgun 12 by a base 13. FIG. 2 shows an upper frame 14, supporting a reticle projection assembly 15 projecting a first reticle 16, and a second reticle 18, onto a front collimating lens 20. A collimating lens renders parallel the rays of light passing through it, in this case from front to back. This removes parallax from a user's field of view through lens 20.

Referring now to FIGS. 3-6, a first reticle elevation adjustment actuator 30, and a second reticle elevation adjustment actuator 32 (FIG. 4), both are both threaded elements, with threaded portion set into a threaded hole 38. Both actuators 30 and 32 have a wide collar 36, which engages into a slot 40, on an LED carriage 42, supporting light emitting diodes (LEDs) 50 and 52, respectively. Consequently, turning actuator 30 causes first LED 50 to move up or down, and turning actuator 32 causes second LED 52 to move forward or backward, which is translated to an elevation movement by being reflected by one-way (or color selective) mirror 60, which passes the light from LED 50.

Figure 6:
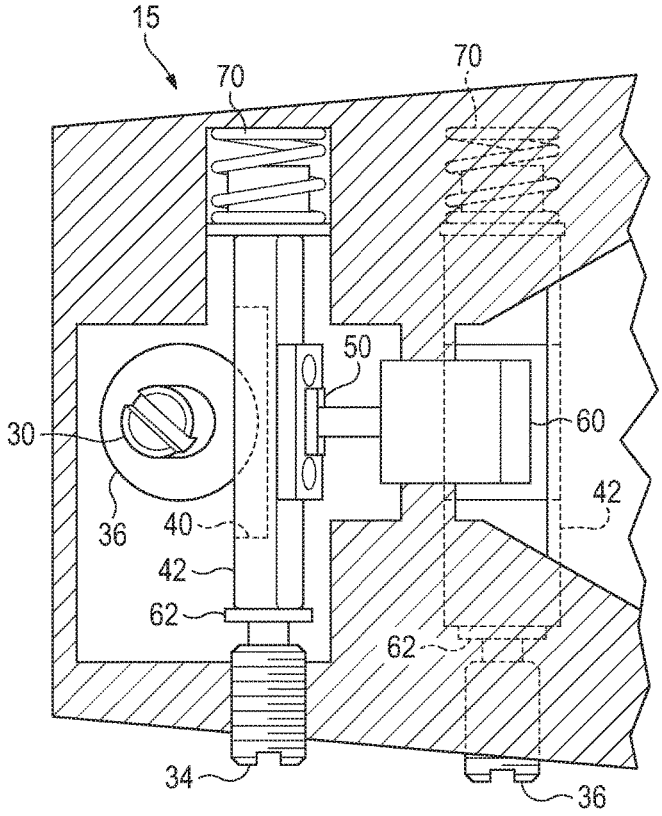
FIG. 6 is a detail sectional view of the reflex sight of FIG. 1, taken along line 6-6 of FIG. 4.

Referring specifically to FIG. 6, both actuator 34 or 36, includes a pedestal 62, which abuts LED carriage 42, so that as either actuator 34 or 36 is rotated, carriage 42 is pushed laterally by a pedestal 62 in a first direction, or pushed by a spring 70 in a second direction, opposite the first direction, permitted by the withdrawal of pedestal 62. In this manner the lateral position of reticles 16 and 18 can be changed.

Figure 7:
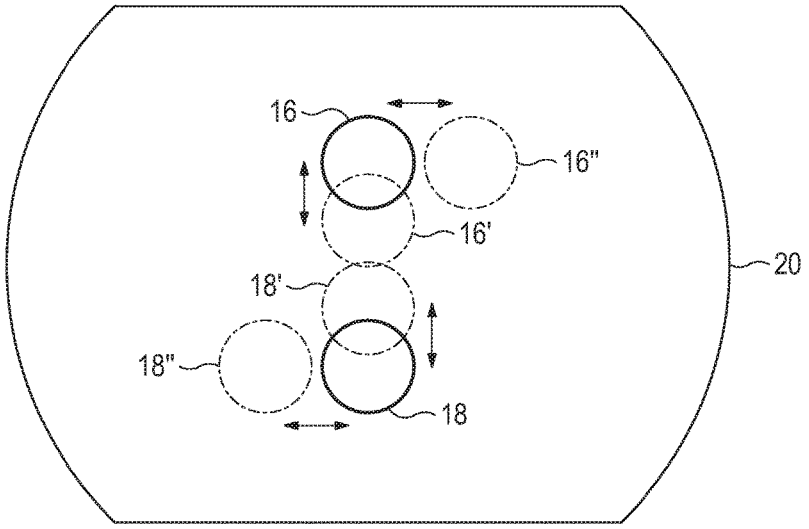
FIG. 7 is an illustration of adjustable reticle positions.
Figure 8:
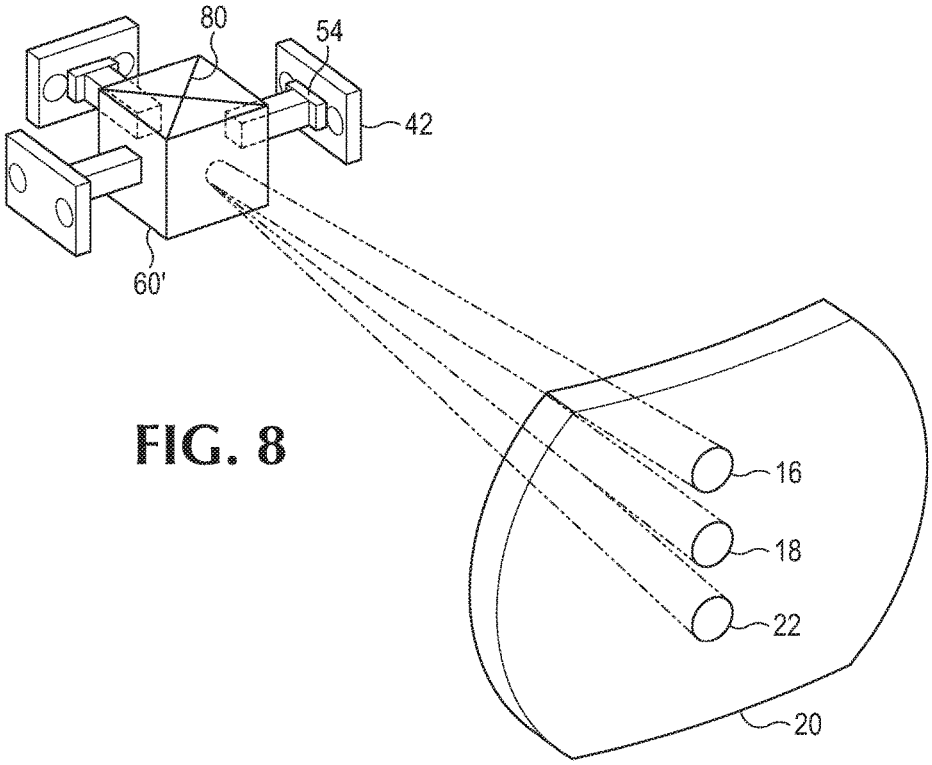
FIG. 8 is an isometric view of an alternative embodiment, in which three reticles are displayed.

FIG. 7 shows an illustration of the movement of reticles 16 and 18, showing that reticle 16 can be moved to position 16' by use of actuator 30, as 18 can be moved to position 18' by actuator 32. Similarly, reticle 16 can be moved to position 16" by actuator 34 and reticle 18 can be moved to position 18" by actuator 36. FIG. 8 is an illustration of a sight having three reticles 16, 18 and 22. To achieve this end an additional LED 54 and carriage 42 is included and the one-way mirror 60 is replaced with mirror 60' having an additional internal reflecting surface 80. The actuating mechanism is like that used to adjust the position of reticles 16 and 18.

Referring, again, to FIGS. 2-4, in an embodiment, upper frame 14 can be shifted relative to base 13 by means of actuator 90, which moves upper frame 14 laterally, and actuator 92 which moves upper frame 14 vertically. Element 96 is a battery receptacle.

In such an embodiment, first reticle 16 does not require its actuators 30 and 34, but in one embodiment is fixed relative to and moved with upper frame 14, with second reticle 18 having an adjustment mechanism so that it can be moved relative to reticle 16. In one such embodiment, there is no actuator 36 for adjusting the windage of reticle 18 relative to that of reticle 16. Windage would typically be adjusted to compensate for any mounting errors of scope 10 and firearm 12, and so both reticles would typically require the same windage adjustment. Accordingly, in one embodiment, actuators 34 and 36 are replaced with a single windage actuator, which branches to move both LED carriages 42 laterally, simultaneously.

In an embodiment, the space between mirror 60 and lens 20 is covered by a portion of housing. Rather than being mounted on a handgun 12, a reflex sight 10, or a related sight permitting relative reticle position adjustment, can be mounted on a rifle, shotgun or crossbow. The embodiment that is covered is generally mounted to a rifle.

In use, a shooter will know the ordinance he is using, and be able to adjust the reticle position so that it matches the bullet drop which is expected for that ordinance at an anticipated target range. Also, there are many situations in which a shooter has some prior knowledge of a range or ranges at which targets are likely to be placed, and with the system described above, he may preadjust his reticles to anticipate bullet drop at these ranges. For example, in the increasingly popular shooting sport of three-gun competition, in which a contestant armed with a rifle, a shotgun and a handgun runs through a course, shooting at various sets of targets, the course is known ahead of time to the contestants. Accordingly, for each gun, the contestant may adjust his reticles at two optimum positions, for the most frequently encountered bullet drops, or to frame the anticipated range of bullet drops, for speedy interpolation as he negotiates the course. With only a set of two or three reticles, the shooter is relieved of the task of choosing one out of an extensive set of markings visible through the sight, a task he is confronted with if using some existing sighting systems. In a competition where every second counts, this can make a significant difference.

In one style of hunting, the hunter lays in wait for quarry to appear. In preparation for quickly shooting an animal that wanders into his field of view, a hunter will typically "sight in" a physical feature in his field of view, using a range finder to measure range to that feature, so that he can quickly judge the range of an animal that approaches the feature or wanders in between the hunter and the feature. With the sight described above, the hunter may adjust one of the reticle positions so that it matches anticipated bullet (or pellet) drop at the range to the feature that has been sighted in.

Figure 9:
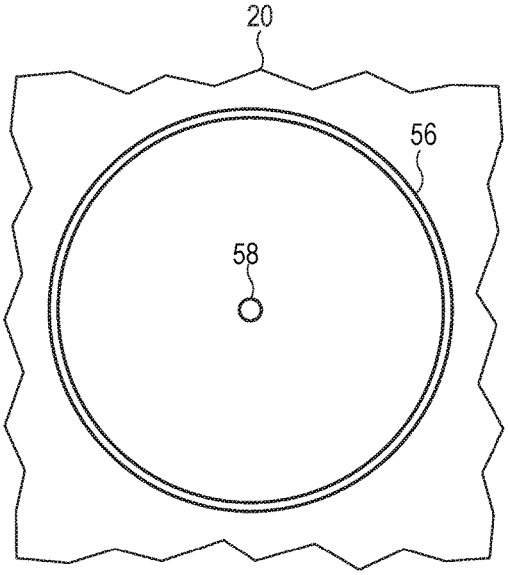
FIG. 9 is an illustration of a reflex sight display, showing reticles of different sizes.

Referring to FIG. 9, in a preferred embodiment of a sight for use with a handgun, two reticles are made available: a larger diameter reticle 56 for short range shooting and a smaller diameter reticle 58 for long range shooting. In embodiments, a switch or pair of switches is provided to selectively illuminate these reticles, as chosen by a user. The larger diameter reticle 56 may be used to indicate, for example, the area over which a gun may be pointed to hit a target that covers an area. The shooter may aim to place the entire reticle 56 over an area target to avoid potential collateral damage. When speed of shooting is essential, this excuses the shooter from the need to align a smaller reticle to the center of a target. But for longer range shooting, a smaller diameter reticle, such as reticle 58, may be necessary to align to a target that appears smaller in the field of view. In additional preferred embodiments, reticles 56 and 58 may be the same size, but differing in appearance in some other way, for example in color or brightness or both color and brightness. Or they may be shaped differently.

Figure 5:
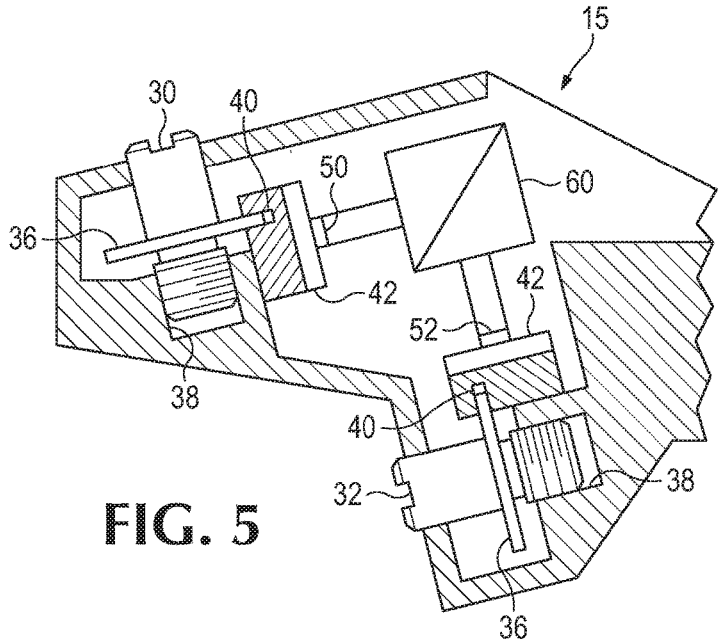
FIG. 5 is a detail sectional view of the reflex sight of FIG. 1, taken along line 5-5 of FIG. 3.
Figure 10:
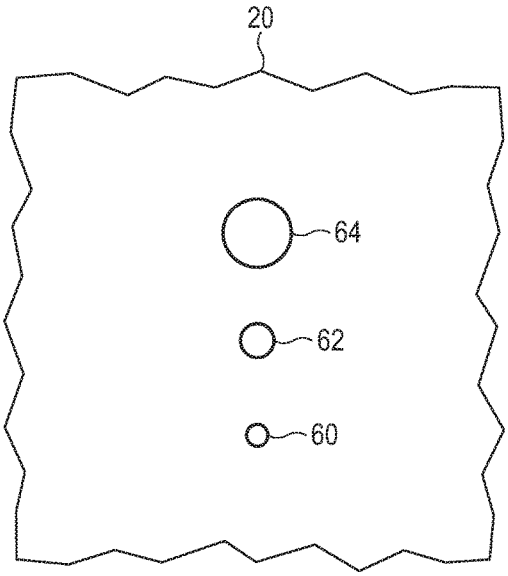
FIG. 10 is an illustration of a reflex sight display, showing reticles of different sizes, arranged according to different bullet drops, from different ranges.

Reticles 56 and 58 may be separately controlled, by mechanisms such as those shown in FIGS. 5 and 6. Referring to FIG. 10, in another embodiment, a set of three reticles 60, 62 and 64 are provided, arranged according to bullet drop to be expected at varying ranges, with reticle 60 being sized and positioned for long range shooting, reticle 64 sized and positioned for short range shooting, and reticle 62 adapted for medium range.

Figure 11:
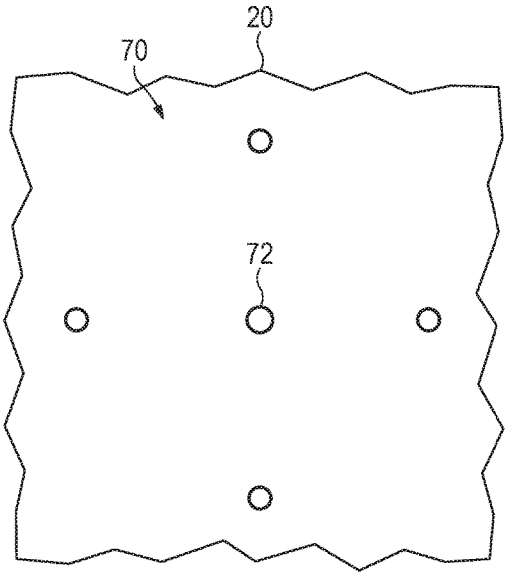
FIG. 11 is an illustration of a reflex sight display, having a set of reticles, indicating ordinance spread.

Referring to FIG. 11, in one embodiment, an LED array is used to display a shape or set of points 70 (forming a shape) to a user, indicating ordinance spread (a likely hit zone) of a bullet, or in the case of a shotgun, pellets. A middle reticle 72 is also provided in some embodiments, for aiming. For a handgun, the angle at which a bullet leaves the gun barrel is subject to a fair amount of uncertainty, because the barrel is so short that it cannot impart the necessary spin or impose a definite and repeatable path to the degree that a rifle does. Accordingly, a shooter may wish to have an indication of his chance of hitting a target, by placing the display of reticles or a single reticle covering an area, over a target of interest, for example a person. Such a display can also aid a shooter in avoiding collateral damage, by showing for example, if the area over which a bullet might hit includes an innocent party, such as a bystander or a hostage.

For a shotgun, the pellets begin to spread out after leaving the gun barrel, covering a larger area as they progress forward. Again, the area covered by the cloud of pellets is of interest to a shooter and a reticle set 70 indicating this area, is useful. A shotgun will typically include a choke, which can be used to change the rate at which the pellets spread, as they progress. In one embodiment, the reticle set 70 may be changed in arrangement to reflect a different choke setting. In a further embodiment, a communicative link is established between the shotgun and the sight, either wirelessly, by an electrically conductive pathway or a fiber optic link, to permit the choke position to be automatically relayed to the sight, and to automatically cause an adjustment to the arrangement of the reticle set 70, so that the arrangement of the reticle set 70 reflects the spread of the shotgun pellets. Applicant notes that a set of LEDs may be spread apart or brought into closer configuration without the complexity of the arrangement shown in FIGS. 5 and 6, if independent positioning is unnecessary. Ideally, the reticles should move diagonally in the field of view, in the same way pellets spread out. In one method for actualizing such an arrangement, a set of reticles are positioned on the ends of arms joined at a point and slide against a glass pain, arranged so that light from the reticles is projected onto front lens 20. As the point is moved closer to or further from the glass pain the reticles spread out or are brought closer together, respectively. In one embodiment, tracks are etched in the glass pane to guide the movement of the LEDS. In an alternative embodiment, LEDs are moved in diagonal tracks, by mechanical linkages, electromechanical actuators or piezoelectric actuators.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A reflex sight, comprising:

(a) a mounting base, including an engagement element for attachment to a firearm;

(b) a collimating front lens, having a reflective surface, mounted on said mounting base;

(c) a first reticle projection system, including a first light emitting diode, and projecting a first reticle onto said reflective surface, at a first position, said first position being user adjustable, relative to said mounting base, by a first actuation assembly;

(d) a second reticle projection system, including a second light emitting diode, and projecting a second reticle onto said reflective surface at a second position, said second position being user adjustable, relative to said first position by a second actuation assembly; and (e) wherein light from said first light emitting diode is transmitted through a one-way mirror and light from said second light emitting diode is reflected by said one-way mirror, onto said collimating front lens.

2. The reflex sight of claim 1, wherein said first actuation assembly permits user adjustment of elevation of said first position, relative to said mounting base.

3. The reflex sight of claim 2, wherein said second actuation assembly permits user adjustment of elevation position of said second position, relative to first position.

4. The reflex sight of claim 2, wherein said first actuation assembly also permits user adjustment of windage of said first position, relative to said mounting base.

5. The reflex sight of claim 4, wherein said second actuation assembly permits user adjustment of windage of said second position, relative to said first position.

6. The reflex sight of claim 1, wherein said reticles are user adjustable by way of a set of threaded elements, each threaded element being engaged to a further element upon which a light emitting diode is mounted.

7. The reflex sight of claim 1, wherein first actuation assembly moves both said first position and said second position.

8. The reflex sight of claim 1, wherein said first actuation assembly moves said first position relative to said second position, as well as relative to said base.

9. The reflex sight of claim 1, further including a third reticle projection system, projecting a third reticle onto said reflective surface at a third position.

10. A reflex sight displaying a pattern of reticles in a field of view providing an indication of two-dimensional angular area in said field of view, and wherein said pattern of reticles adjustable to cover a larger or smaller angular area in said field of view, to reflect ordinance spread for a specific ordinance and firearm used.

11. The reflex sight of claim 10, wherein said reticle pattern is a set of reticles that move diagonally in said field of view, when said reticle pattern is adjusted.

12. The reflex sight of claim 10, wherein said pattern of reticles includes four reticles.

* * * * *